US005245841A

United States Patent [19]

Paul et al.

[11] Patent Number: 5,245,841

[45] Date of Patent: Sep. 21, 1993

[54] UNDERCOUNTER ICE MAKING MACHINE

[75] Inventors: Roger W. Paul, Antioch; Karl F. Jobst, Spring Grove, both of Ill.

[73] Assignee: Scotsman Group, Inc., Vernon Hills, Ill.

[21] Appl. No.: 980,742

[22] Filed: Nov. 24, 1992

[51] Int. Cl.[5] ..... F25D 23/10

[52] U.S. Cl. ..... 62/302; 62/344; 312/257.1

[58] Field of Search ..... 62/302, 344, 298, 354; 312/198, 201, 257.1

[56] References Cited

U.S. PATENT DOCUMENTS

| | | | |
|---|---|---|---|
| 2,297,371 | 9/1942 | Siedle | 62/105 |
| 2,526,262 | 10/1950 | Munshower | 62/105 |
| 2,722,110 | 11/1955 | Denzer | 62/107 |
| 2,887,852 | 5/1959 | Thomas | 62/135 |
| 3,411,569 | 11/1968 | Hildreth | 62/302 X |
| 3,796,063 | 3/1974 | Wulke et al. | 62/340 |
| 4,287,725 | 9/1981 | Hoenisch | 62/344 |
| 4,341,087 | 7/1982 | Van Steenburgh, Jr. | 62/233 |
| 4,457,140 | 7/1984 | Rastelli | 62/261 |
| 4,489,567 | 12/1984 | Kohl | 62/138 |
| 4,672,818 | 6/1987 | Roth | 62/298 X |
| 4,706,466 | 11/1987 | Yingst et al. | 62/138 |
| 4,977,750 | 12/1990 | Metcalfe | 62/298 X |
| 4,995,243 | 2/1991 | Ward | 62/298 |
| 5,140,830 | 8/1992 | Sawyer | 62/298 |

OTHER PUBLICATIONS

Scotsman Model AC-20 Automatic Cuber, Service Manual dated Jul., 1978: front face, IV, p. 8, VIII, pp. 2-5 and 26-27.

*Primary Examiner*—William E. Tapolcai

*Attorney, Agent, or Firm*—Harness, Dickey & Pierce

[57] ABSTRACT

In an under the counter ice making machine for producing an ice product, a two-part freezer compartment is removably assembled to a frame. The freezer compartment includes an upwardly open box-shaped lower ice bin and an upper hood that is removably mounted in covering relation to the top of the ice bin. The ice bin is mounted to and removed from the frame only when the hood is removed. The ice bin has a rear end wall and a pair of sidewalls extending vertically upwardly and the bin is mounted by rotating the bin and its rear end wall into position on the frame and seated behind an abutment shoulder extending from the frame. Thereafter, the hood is assembled to and removed from the ice bin by a horizontal sliding movement of its sidewalls along the top surfaces of the bin sidewalls. Removal of the bin is accomplished by forcing the rear end wall against the shoulder and then simultaneously rotating the entire bin, thereby causing the forward end to lift vertically upwardly from the base and the rear end wall to drop below the abutment shoulder, and moving the bin horizontally outwardly.

17 Claims, 4 Drawing Sheets

UNDERCOUNTER ICE MAKING MACHINE

BACKGROUND OF THE INVENTION

This invention relates to an ice making machine and more particularly to an improved under the counter ice making machine.

Undercounter ice makers are known, such as the "Under the Counter Ice Making Machine" shown in U.S. Pat. No. 4,706,466 issued Nov. 17, 1987. In this machine, an evaporator for making ice is mounted on a rear wall extending upwardly from a bottom compartment and a one-piece freezer compartment is sealed against the rear wall and removed in a sliding movement whereby to gain access to the refrigeration system, water system and control system components. In order to remove the freezer compartment screws must be removed from the top panel of the unit. These screws are not accessible in some installations. While this machine is nonetheless believed to adequately perform its ice making function, there is always a need for improvement in the total user friendliness of such apparatus.

It is an object of this invention to provide an improved under the counter machine free of the above-mentioned drawbacks for making an ice product, such as cubed or flaked ice.

SUMMARY OF THE INVENTION

According to this invention there is provided an under the counter ice making machine of the type including a refrigeration system including an evaporator for producing an ice product, a frame including a base plate and a support bracket for supporting the evaporator above the base, an upwardly open bottom compartment associated with said base for housing various machinery and the other major components of the refrigeration system, and an ice storage compartment removably mounted to the frame above the bottom compartment. The refrigeration system further includes in the bottom compartment a condenser, a condenser fan and a compressor, and suitable lines and connections to fluid and electrical sources to supply water and electricity as needed for the ice making operation. The evaporator can be of the auger-type used to form a flaked ice product or in combination with a water distributor used to form a cubed ice product.

In a preferred embodiment of the invention, the bottom compartment is protectively closed by a removable partition, the support bracket and an evaporator bracket member are mounted to the frame vertically above the partition, and the ice storage compartment is of two piece construction, the compartment including a lower ice bin removably supported on the partition and a hood adapted to be slidably removably mounted on the top of the ice bin. An abutment shoulder of the evaporator bracket seats against the upward extension of the rear end wall of the ice bin, positions the ice bin to receive ice discharged from the evaporator, prevents forward sliding movement of the bin when mounted to the partition, and forms a pivot point for the bin. The hood is mounted on and removed from the ice bin with a slight lift and then a horizontal sliding action. The ice bin is mounted on and removed from the frame only when the hood has been removed and by rotating the bin and the upward extension of the rear end wall relative to the abutment shoulder such that the end wall is positioned below the shoulder and the lower front end of the bin is lifted upwardly from the partition and simultaneously pulling the bin away from the frame.

In addition to forming a support for the ice bin, the partition covers the bottom compartment to protect the bottom compartment components from dirt or water leakage from melted ice when the ice bin is removed. A removable rear panel extends vertically upwardly from the base in covering relation to the evaporator panel to permit rearward access to the refrigeration system and controls.

Advantageously, the unit is serviceable in place; the hood may be removed independently of the ice bin to provide access to the evaporator; the removable rear panel protects the rear of the machine, and the hood may be easily removed from the machine frame to allow service access without removing the ice machine from its installed location.

Further, the hood and ice bin portions are removably secured by means accessible directly via the access into the front end of the ice bin. The assembled ice storage compartment is easily removably secured to the frame to prevent unwanted removal when the machine is in use.

These and other objects and advantages will become apparent to those skilled in the art upon the reading of the following description with reference to the accompanying drawings wherein like numbers refer to like parts throughout the several views.

DETAILED DESCRIPTION OF THE PREFERRED EMBODIMENT

FIGS. 1–7 illustrate exemplary preferred embodiments of a compact ice maker of the type which is adapted to be installed for use in a space 10 formed under a counter 12 (shown in phantom) and which can be disassembled in place to permit cleaning of the machine and/or repair of machine parts when needed. The embodiments selected herein are exemplary of apparatus for producing flaked ice and cubed ice. It is to be understood that FIGS. 1–7 are exemplary and that the present invention is applicable to other refrigeration apparatus that must be removably mounted under a counter where available space is extremely limited.

Figure 1:
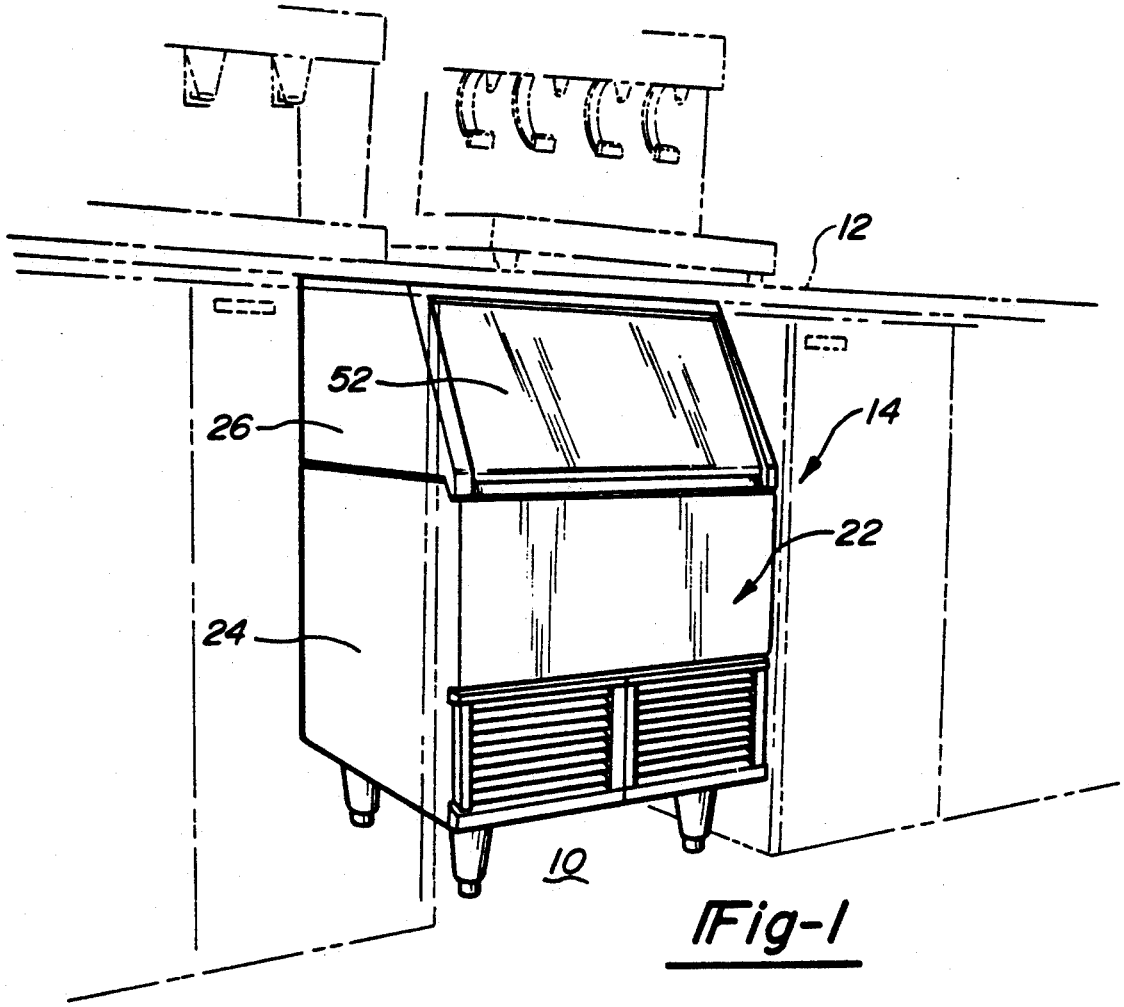
FIGS. 1–3 are perspective isometric views of an under the counter ice making machine according to this invention and showing, respectively, the machine operably positioned for use under the counter, an upper hood being removed from a lower ice bin by a slight lift and a horizontal sliding motion, and the ice bin being removed from the machine by simultaneously pivoting and vertically lifting the bin relative to the machine frame.
Figure 2:
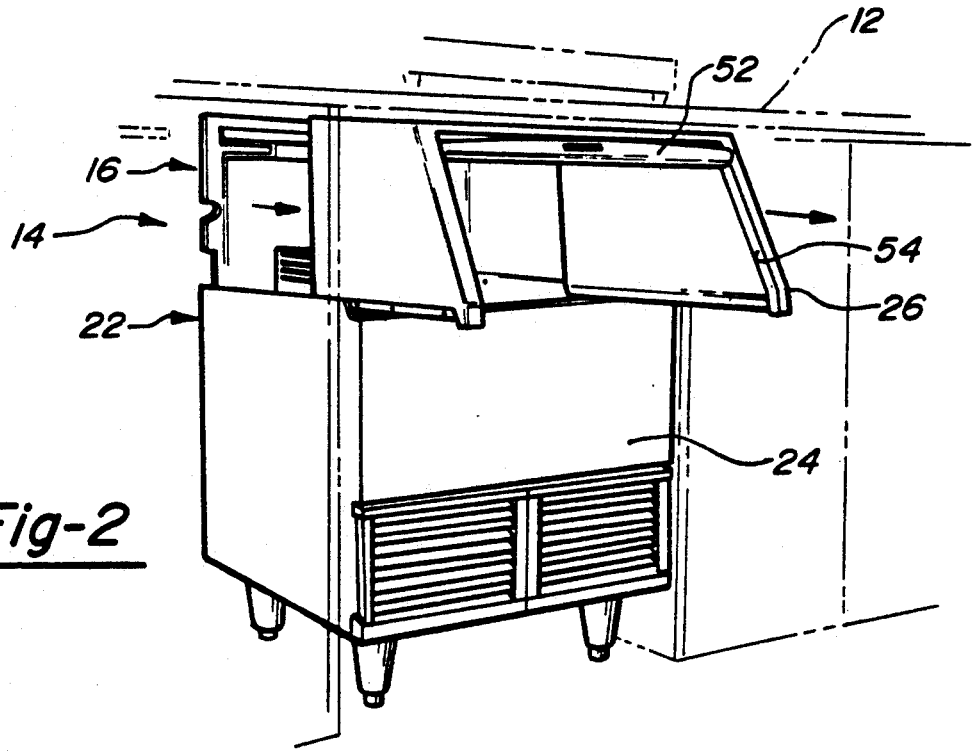
Figure 3:
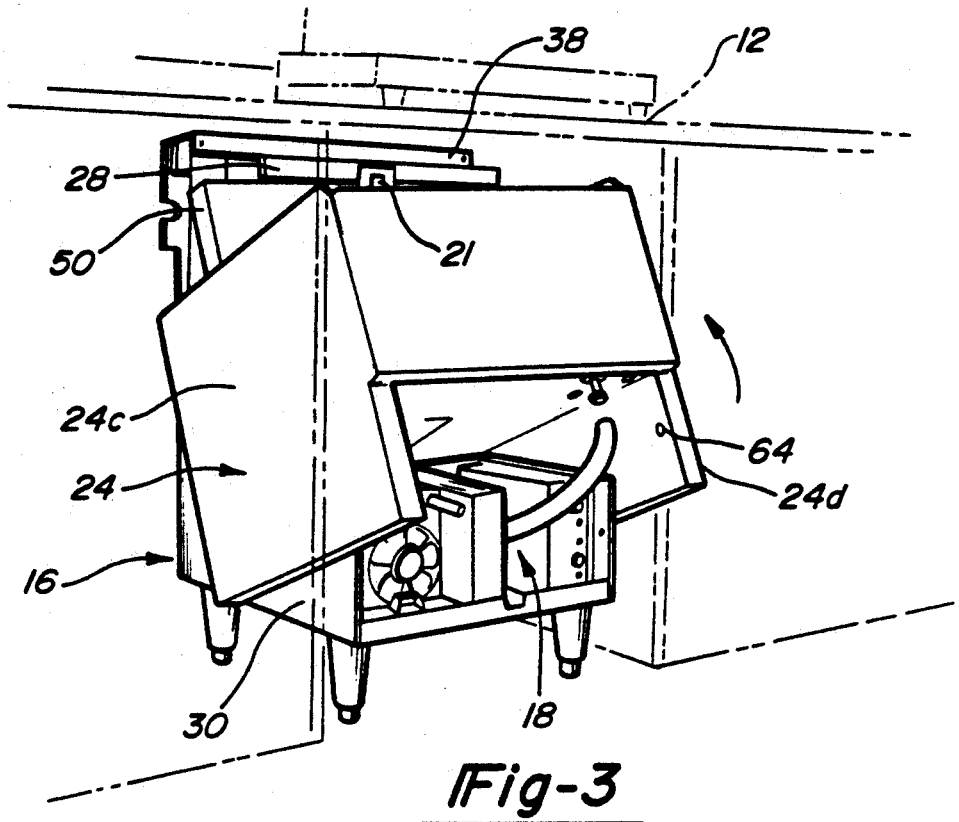
Figure 6:
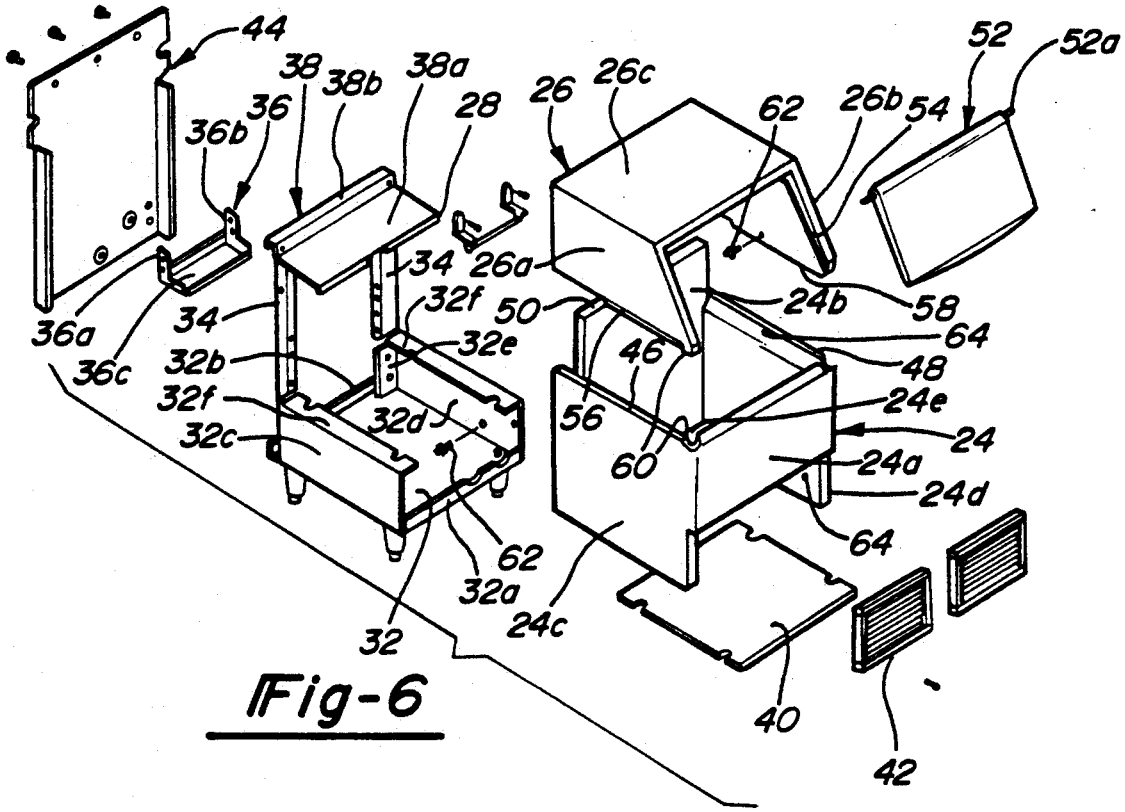
FIG. 6 is an exploded disassembly view of the machine frame.
Figure 4:
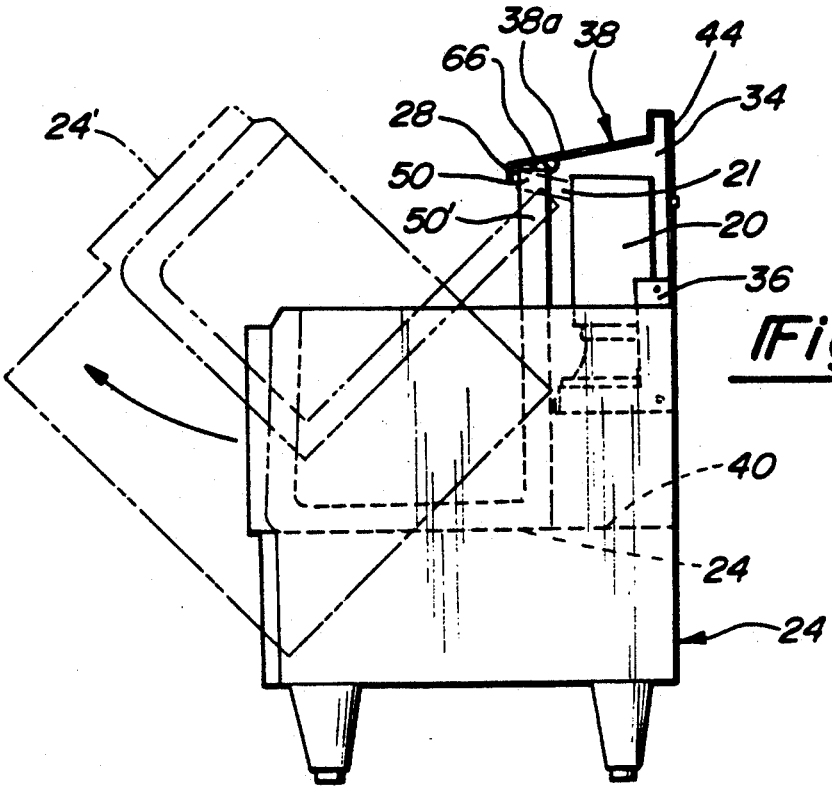
FIG. 4 is a side elevation view showing the pivoting removal of the ice bin.
Figure 5:
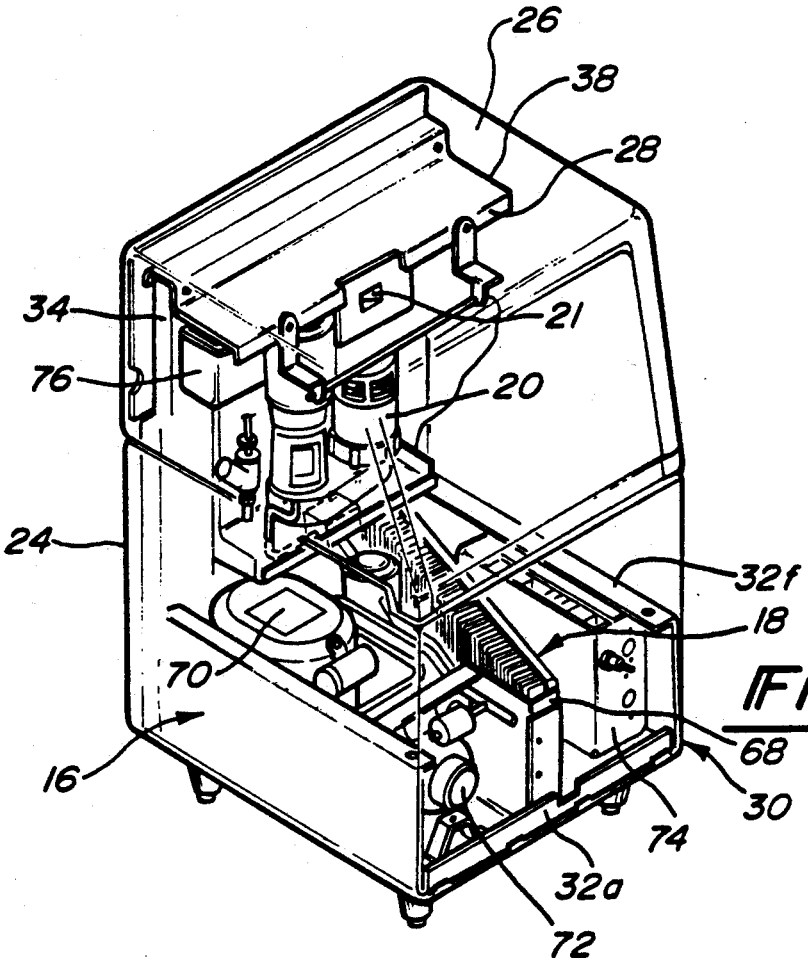
FIG. 5 is a partial cutaway view looking downwardly on the frame and the refrigeration components of the machine for producing flaked ice following removal of the hood, bin and machine compartment cover.
Figure 7:
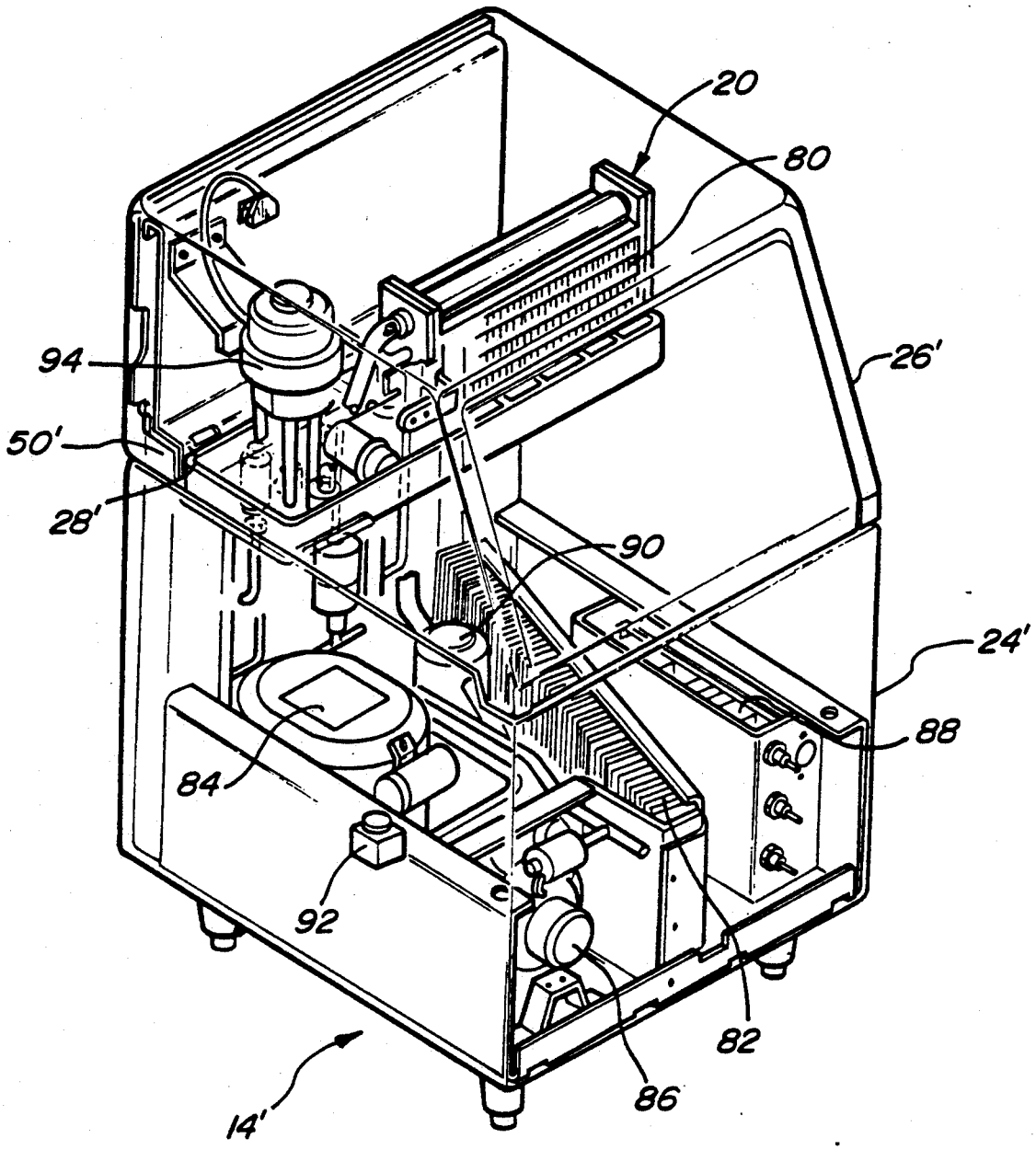
FIG. 7 is a partial cutaway view looking downwardly on the frame and the refrigeration components of a machine for producing cubed ice following removal of its hood and bin.

In the description to follow, FIGS. 1-6 are directed to a machine for making flaked ice and FIG. 7 is directed to a machine for making cubed ice. While the refrigeration components are different in some respects, each machine can include a two-part ice storage compartment that includes a bin portion that is pivoted relative to the machine frame.

Referring to FIGS. 1-6, an undercounter flaker 14 comprises a frame 16, a refrigeration system 18 mounted on the frame, the refrigeration system including an evaporator 20 for making flaked ice, and a two-part freezer or ice storage compartment 22 assembled to the frame. Importantly, the ice storage compartment 22 comprises a lower upwardly open ice bin 24 and a removable hood 26 that are assembled to the frame, and an abutment shoulder 28 is mounted to the frame to assist in assembly and removal of the ice compartment.

The frame 16 comprises a bottom compartment 30 for housing both refrigeration and machine components and is formed in part by a horizontally disposed base plate 32, two support channels 34 of pan-shaped cross-section extending vertically upward from opposite respective rear side corners of the base plate, an L-shaped support bracket 36, and an evaporator bracket member 38. The bottom compartment is formed in part by the base plate 32 having all four of its side portions thereof turned vertically upwardly whereby to form front and rear flanges **32*a* and 32*b* and a pair of sidewalls 32*c* and 32*d*. Each support channel 34 is secured at its bottommost end to the base plate, along a portion of its vertical length to a respective rear end flange 32*e* turned inwardly from a respective sidewall 32*c* and 32*d*, along a portion of its vertical length to the support bracket 36, and adjacent to its uppermost end to the evaporator bracket 38** whereby to mount the evaporator bracket vertically above the base plate.

The bottom compartment is further formed by a removable partition 40, a pair of removable grilles 42 extending in side by side covering relation across and connected to the front flange **32*a*, and a removable rear panel 44. The opposite lateral edges of the partition 40 are supported on and fastened to respective inturned flanges 32*f* that extend from the top of the sidewalls 32*c* and 32*d***.

The rear panel 44 has top and bottom end portions, and a pair of inturned side flanges extending vertically between the top and bottom ends. The top and bottom end portions and the flanges of the panel are removably connected to the upturned rear flange **32*b* of the base plate 32, the bracket member 38 and the two support channels 34, whereby to conceal the back of the frame and close the back of the bottom compartment to prevent dirt or other debris reaching the machine components therein. Importantly, since the evaporator is secured only to the support bracket 36, the rear panel 44** may be removed to provide access to the evaporator, such as for cleaning or servicing, without removing the evaporator.

The evaporator 20 is vertically positioned relative to the frame 16 and between the brackets 36 and 38 and includes a dispenser 21 for supplying ice to the bin positioned between the ends of the abutment 28. The L-shaped support bracket 36 is laterally mounted between the two support channels 34 and includes a pair of arms **36*a* and 36*b* for connection to the channels 34 and a support shelf 36*c* for supporting the evaporator. The evaporator bracket 38 includes a planar first portion 38*a* disposed horizontally for positioning the upward extension of the evaporator and a downwardly open channel portion 38*b* of U-shaped cross-section to coveringly seat on the topmost vertical extensions of the support channels and mount the bracket 38 thereto. The front edge of the bracket portion 38*a* is bent downwardly whereby to form the abutment shoulder 28** and define therebehind a lateral recess to receive and position the rear wall of the ice bin.

According to an important feature of this invention, the ice compartment 22 is of separable two-part construction and includes the bin 24 and hood 26 which are assembled onto the frame in a first and second mounting and/or dismounting step. The ice bin 24 is generally rectangularly shaped and has a front wall **24*a*, a rear wall 24*b*, and a pair of sidewalls 24*c* and 24*d* extending vertically relative to a bottom wall 24*e* so as to be upwardly open to receive ice dispensed from the evaporator 20. The bottom wall 24*e* is generally horizontally disposed and supported in covering relation on the upper surface of the partition 40. The sidewalls 24*c* and 24*d* form skirts which extend downwardly to cover the sidewalls 32*c* and 32*d* of the bottom compartment and upwardly to form a pair of horizontal support surfaces 46 and 48. The bin rear wall 24*b* is configured to have an upward extension 50 to abut the downward extension of the abutment shoulder 28. The shoulder 28 inhibits forward horizontal movement of the bin 24** relative to the bottom compartment when mounted thereon and forms a pivot used to assist in pivoting the bottom bin.

The hood 26 is generally U-shaped and has a pair of sidewalls **26*a* and 26*b* extending vertically from the opposite lateral edges of a top panel 26*c*. The front and the rear of the hood is open with the front being adapted to receive a door 52 mounted for a slidable closing movement in the front opening. In the embodiment shown, grooves or tracks 54 are formed in confronting interior surfaces of the hood sidewalls 26*a* and 26*b* to receive respective guide pins 52*a* from the door 52**.

The bottom surfaces of the two sidewalls **26*a* and 26*b* of the hood define mating faces 56 and 58 that are slidably supported on the top supporting surfaces 46 and 48 of the two sidewalls 24*c* and 24*d* of the ice bin for horizontal separating movement. Further, the mating faces of the bin and hood sidewalls are sloped adjacent to the front of the machine to form a pair of abutment shoulders 60** which act to limit the inward movement of the bin.

The top hood 26 may be removed from the bottom ice bin 24 by a slight lift and then a sliding action between the mating surfaces formed by the sidewalls of the bin and hood. The bottom ice bin can be removed from the base on which it is supported only by rotating the bottom bin and pivoting the portion 50 of the rear end wall downwardly relative to its seating under the pivot shoulder 28. Removal of the top and bottom bins exposes the partition plate but does not expose the refrigeration system or machine components located within the bottom compartment.

Fastening members 62 are arranged to releasably secure the hood to securements 64 in or both sidewalls of the bin. For service, the fasteners are released, the hood is slid forwardly relative to the bin and removed therefrom, and the bin is rotated and lifted vertically relative to the frame. The partition is then removed, if desired, to expose certain components of the refrigeration system. Additionally, a fastener 62 and 64 arrangement operates between the base plate walls **32*c* and 32*d*** and the compartment walls 24c and 24d to releasably connect the ice compartment to the frame.

A seal arrangement operates to seal the freezer compartment when mounted to the frame. A seal member 66 is provided to seal between the two support channels and the vertical rear faces of the hood sidewalls, between the abutment shoulder 28 and upward extension 50 of the rear wall of the bin (see FIG. 4), and between the support channels and the bottom portion of the bin.

The components of the flaker refrigeration system 18 include a condenser 68, a compressor 70, a fan 72 to air cool the condenser, a control box 74, each mounted in the bottom compartment, a water reservoir 76 and associated tubing, and the evaporator 20. By themselves these elements are conventional and form no part of the invention as such. In some units, the air cooling fan could be replaced with a water cooling unit. A full bin is determined by temperature sensing.

For assembly, the bin is lowered onto the frame, positioned such that the rear wall is at an angle and below the shoulder 28, and moved inwardly towards and against the support channels. The front of the bin is lowered such that the upward extension 50 of the rear wall is rotated forwardly and against the seal member 66 on the abutment shoulder. The mating faces 56 and 58 of the hood sidewalls are positioned on the upward extended surfaces 46 and 58 of the bin sidewalls and the hood forced horizontally inwardly, causing the end faces of the hood to abut the seals on the support channels when the front shoulders 60 abut the bin. The fastener members 62 would then be installed to secure the hood relative to the bin. Removal would be the reverse of the above steps. Once mounted, the refrigeration system would be operated to make ice.

In operation, water flows into the reservoir 76 where it then flows by gravity to the bottom of the evaporator 20. In the evaporator, the water chills into ice crystals and is pushed up the evaporator by an auger. To form the ice, hot discharge gas is pumped from the compressor to the condenser, either air or water cooled. At the condenser, heat from the refrigerant flows into the cooling medium and the refrigerant condenses into a liquid. From the condenser, the liquid refrigerant flows through a liquid line to an expansion valve and passes from a high pressure zone into a zone of relatively low pressure (i.e., the evaporator). At this lower pressure zone the refrigerant evaporates. When the refrigerant evaporates it absorbs heat from the metal parts and the water inside it, to make ice which is dispensed via outlet 21 to the bin. From the evaporator, the refrigerant flows back to the compressor.

FIG. 7 illustrates a machine 14, for making cubed ice that includes a two-part bin and hood freezer compartment arrangement which is similar to that described above but the machine mounts different refrigeration components. In particular, due to difference in the evaporator assembly 20' and ice mold plate 80 which must be supported on a support bracket 38', the ice bin 24' is modified as regards the upward extension 50' of its rear wall to ensure that the extension seats behind the support panel 28'.

The refrigeration system includes an air cooled condenser 82, a compressor 84, a fan 86 to cool the compressor, a control box 88, an expansion valve 90, a purge valve 92, and associated tubing, each in the bottom compartment, and a water pump 94, a hot gas valve 96, and water distributor plate and evaporator 80 mounted on the support bracket. The ice product is formed into a slab on the inclined, generally vertically disposed, mold plate 80 and harvested by passing a hot gas through the plate. The slab of ice then falls vertically into the bottom bin to break up.

The ice making machines 14 and 14' described hereinabove are desirably intended for use in a tight space under a counter although it will be appreciated they can be used in an open space. No clearance is required at the sides or top of the machine beyond what is needed to place the frame into position.

While the above description constitutes the preferred embodiment of the invention, it will be appreciated that the invention is susceptible to modification, variation, and change without departing from the proper scope or fair meaning of the accompanying claims.

What is claimed is:

1. An under the counter ice making machine comprising:

a base plate;

a two-part freezer compartment removably assembled to said base plate and including a hood having a top panel and an upwardly open ice bin having a rear wall extending vertically and adapted to be removably covered by the hood;

a pair of support channels extending upwardly of the base plate towards the top panel of the hood;

a support bracket spaced above the base plate and connected to each of the support channels;

refrigeration means for making ice, including a condenser, condenser fan, and compressor supported on the base plate and an evaporator mounted to said support bracket; and an evaporator bracket positioned above the evaporator and including an abutment shoulder adapted to seat against the rear wall of said ice bin, said hood being removably mounted to or removed from the bin in a horizontal sliding movement removal from the bin, and said bin being removably mounted to or removed from to the frame only with the hood removed and by a combined action of rotating the bin relative to the plate whereby to pivot the rear end wall of the bin into or from seated engagement with the abutment shoulder and sliding the bin.

2. An under the counter ice making machine as claimed in claim 1 wherein said ice bin includes a pair of sidewalls, a front wall, and said rear wall, and said hood includes a pair of sidewalls and said top panel, the sidewalls of said bin and said hood forming horizontal mating faces which permit the hood to slide relative to the bin when the hood is assembled to the bin.

3. An under the counter ice making machine as claimed in claim 1 wherein the evaporator means includes means for producing flaked ice.

4. An under the counter ice making machine as claimed in claim 1 wherein said evaporator means includes vertically disposed means for forming ice cubes, and means for harvesting the ice cubes.

5. An under the counter ice making machine as claimed in claim 1 wherein the top panel and the side walls of said hood cooperate to form at a front portion a door supporting means; and further including a door means, including a door mounted in the door supporting means, for opening and closing the freezer compartment.

6. An under the counter ice making machine as claimed in claim 2 including limit means for limiting inward sliding movement of the hood relative to the bin.

7. An under the counter ice making machine as claimed in claim 6 including seal means for sealing thermally between said support channels and the rear sidewalls of the hood, and the rear wall of said bin and the abutment shoulder, said sealing operating when said bin and hood are assembled into position.

8. An under the counter ice making machine as claimed in claim 7 wherein said evaporator is enclosed in part by said hood.

9. An under the counter ice making machine as claimed in claim 1 further comprising compartment means for enclosing said condenser, condenser fan, and compressor, said bottom compartment means including said base plate being generally rectangular and formed to include a pair of upturned sidewalls each adapted to be confronted by a respective sidewall of the freezer compartment, a front flange for mounting an air passage grille, and a rear flange for mounting a rear panel, and a partition fastened to the base plate sidewalls to space the partition from the base plate.

10. In an under the counter ice making machine of the type including (a) refrigerator means including a condenser, condenser cooling means, a compressor, and evaporator means for producing an ice product; (b) frame means for mounting said refrigerator means said frame means including a bottom compartment for housing the condenser, condenser cooling means, and compressor, and support means vertically above the bottom compartment for supporting the evaporator means; (c) and freezer compartment means removably mounted over the bottom compartment for receiving the ice product from said evaporator means, the improvement characterized by a horizontally disposed abutment shoulder; and said freezer compartment means being of two parts and removably assembled to said frame, including an upwardly open ice bin having front and rear walls and a pair of sidewalls, and a removable hood to cover the top of the ice bin and having a pair of sidewalls adapted for slidable mounting to the sidewalls of the bin, the upward extension of said rear wall being adapted to seat behind said abutment shoulder whereby the ice bin is prevented from sliding movement relative to said bottom compartment, the ice bin and its upward extension being rotated relative to the frame means and into and from abutment with the shoulder, respectively, for mounting and removal from said frame means and only with said hood being removed.

11. An under the counter ice making machine as claimed in claim 10 wherein said frame means includes a pair of supports extending vertically upwardly from said bottom compartment, and an evaporator bracket supported above said evaporator by said supports, said bracket extending horizontally and including said abutment shoulder, and said hood being adapted to engage each of the supports and said bracket for enclosing the evaporator.

12. An under the counter ice making machine as claimed in claim 11 wherein said frame means includes a rear panel removably mounted to said supports for closing the back of the machine, removal of said panel allowing access to the evaporator without requiring removal of the evaporator.

13. An under the counter ice making machine as claimed in claim 10 wherein the condenser cooling means is a fan, and the bottom compartment includes a front panel having a grille, said fan operatively positioned with respect to the grille for forcing air in and out of the bottom compartment for cooling the condenser.

14. An under the counter ice making machine as claimed in claim 10 including fastening means, operating between the pairs of sidewalls, for securing the hood to the bin, said fastening means including a fastener accessible only from within the hood and connectible to the sidewall of the bin.

15. An under the counter ice making machine as claimed in claim 11 wherein a seal member operates between the support members and sidewalls of the hood, and the support and the end wall of the bin.

16. An under the counter ice making machine as claimed in claim 10 wherein the bottom compartment includes a base plate formed to include a front and rear flange, and a pair of sidewalls, a partition plate is mounted on the top of said plate sidewalls, and a grille is connected to the front flange to allow air to pass into or from the compartment.

17. An under the counter ice making machine as claimed in claim 10 wherein said freezer compartment means includes the front end portions of the top panel and sidewalls forming the front of the hood being open and having a door guide means, and a door mounted in the guide means for providing access to the ice bin for ice removal.

* * * * *